US005639045A

United States Patent [19]

Dörfel

[11] Patent Number: 5,639,045

[45] Date of Patent: Jun. 17, 1997

[54] METHOD AND WINDING DEVICE FOR WINDING WEBS

[75] Inventor: Gerhard Walter Dörfel, Boll, Germany

[73] Assignee: Beloit Technologies, Inc., Wilmington, Del.

[21] Appl. No.: 424,348

[22] PCT Filed: Aug. 24, 1994

[86] PCT No.: PCT/EP94/02795

§ 371 Date: Apr. 24, 1995

§ 102(e) Date: Apr. 24, 1995

[87] PCT Pub. No.: WO95/05988

PCT Pub. Date: Mar. 2, 1995

[30] Foreign Application Priority Data

Aug. 24, 1993 [EP] European Pat. Off. ..... 93113521

[51] Int. Cl.[6] ..... B65H 18/20; B65H 19/26

[52] U.S. Cl. ..... 242/527; 242/533.3; 242/541.1; 242/541.7; 242/542.2

[58] Field of Search ..... 242/527, 530.1, 242/532.3, 533.2, 533.3, 541.1, 541.4, 541.5, 541.6, 541.7, 542, 542.2

[56] References Cited

U.S. PATENT DOCUMENTS

| | | | |
|---|---|---|---|
| 2,090,130 | 8/1937 | Kittel | 242/541.1 |
| 3,072,353 | 1/1963 | Moser . | |
| 3,759,458 | 9/1973 | Thomas . | |
| 3,817,467 | 6/1974 | Dambroth | 242/533.2 |
| 3,910,517 | 10/1975 | Harrison | 242/542 |
| 4,370,193 | 1/1983 | Knauthe | 242/533.2 |
| 4,465,243 | 8/1984 | Welp | 242/542.2 |
| 4,598,877 | 7/1986 | Oinonen | 242/542.2 |
| 4,988,051 | 1/1991 | Welschlau et al. . | |
| 5,150,848 | 9/1992 | Consani | 242/542.2 |
| 5,310,130 | 5/1994 | Wieland et al. | 242/542 |
| 5,335,871 | 8/1994 | Fissmann et al. | 242/542 |

FOREIGN PATENT DOCUMENTS

| | | |
|---|---|---|
| 0300220 | 6/1988 | European Pat. Off. . |
| 2313943 | 3/1973 | Germany . |
| 4039048 | 12/1990 | Germany . |
| 2157273 | 4/1985 | United Kingdom . |

*Primary Examiner*—John M. Jillions

*Attorney, Agent, or Firm*—Dirk J. Veneman; Raymond W. Campbell; Gerald A. Mathews

[57] ABSTRACT

In order to be able to manufacture large-caliber reels of high quality in a twin drum reel-up, the king rolls (11) and (12) have different diameters and are situated at different elevations. The main load of the reel is carried by the king roll (11), while the king roll (12) contacts the reel (13) with the smallest possible nip pressure which just suffices for transferring the torque difference required for generating the desired winding tension of the reel. The king roll (12) may be lowered as the diameter of the reel increases, namely depending on the fact if the winding shaft (13A) is displaced along a predetermined line of motion (14; 15), preferably a linear vertical or slightly tilted line of motion. An additional center drive which is made possible due to the aforementioned measures may additionally improve the winding result. A handling device (50) serves as a multifunction device for exchange of reels, in particular for the ejection of the reels, the clamping of the end of the web and the moving of the end of the web into the position for the next reel, as well as the separation of the finished reel from the web (1; 1', 1", . . . ).

10 Claims, 5 Drawing Sheets

Figure 1:
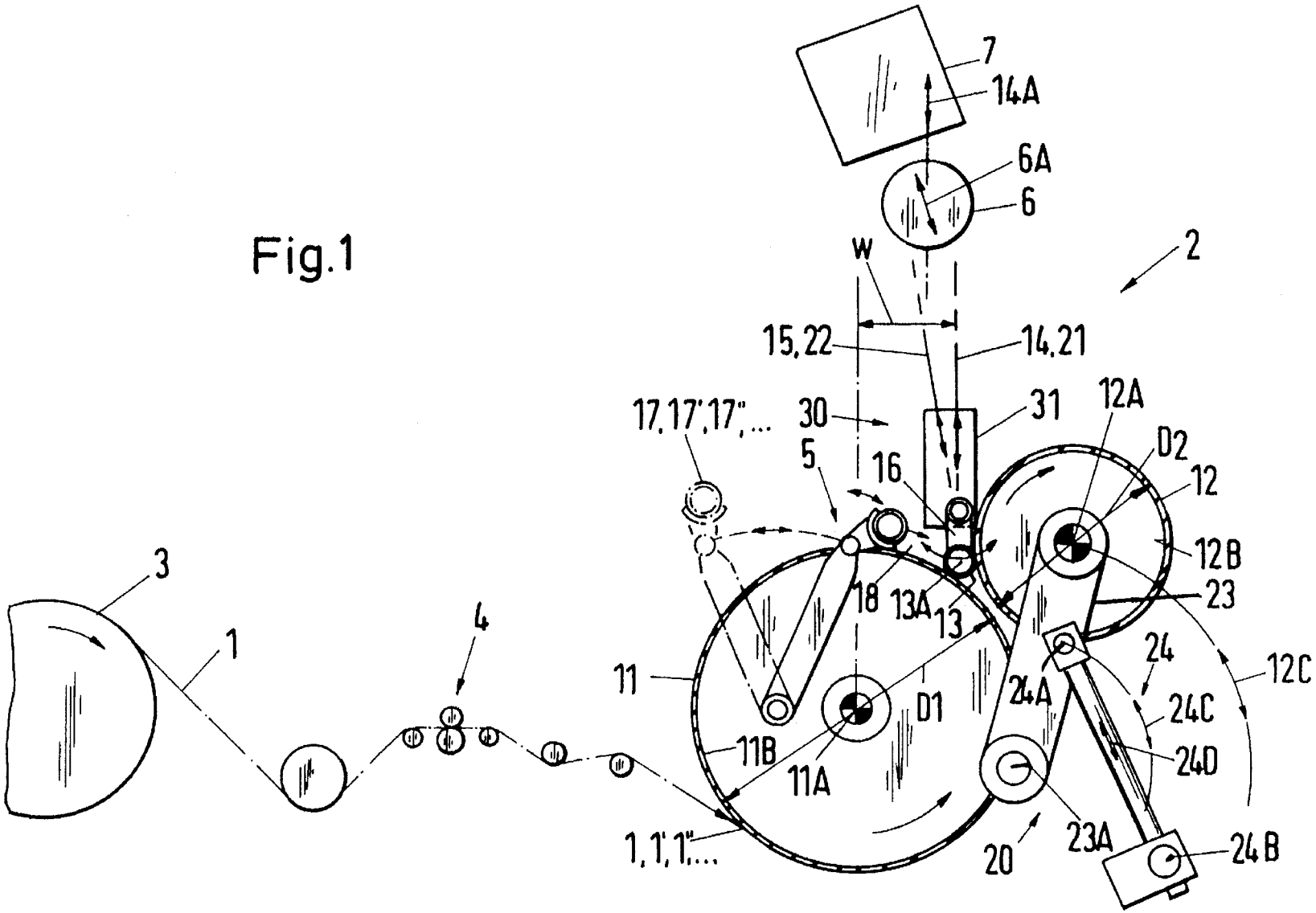

7
6
6A
2
13, 13', 13"
31
30
13B
62
16
13A
8
14A
14, 21
W
61
12
23
18
50
58
52
12C
20
11
11A
59
57
51
55
23A
54
1, 1', 1", ....
60
56

METHOD AND WINDING DEVICE FOR WINDING WEBS

The invention pertains to a method for winding webs as well as a winding device for winding webs. When winding webs by means of so-called twin drum reel-ups, the uniformity of the reel density or the progression of the reel hardness over the entire reel diameter continuously becomes more important as the weight and the winding speed increase. The solutions suggested thus far for insuring a certain density or winding tension are either very complicated or not satisfactory with respect to the winding quality.

A method and a device of this type are known from U.S. Pat. No. 4,465,243. As well as disclosing a winding shaft, this publication proposes two drums of different diameters whose shafts are situated at different elevations for the realization of a uniform density winding. This publication also discloses a formula, according to which the angle between the connecting line between both drum shafts and the horizontal direction may be calculated in dependence on the two diameters of the drums, the size of the gap between both drums and the maximum reel diameter, whereby the aforementioned angle insures an optimally uniform reel density. This angle remains unchanged during the winding process.

The ability to change this angle also is mentioned as a theoretical possibility in the aforementioned publication. The present invention is based on this last-mentioned variation.

A summary of the known possibilities for controlling the reel hardness in twin drum reel-ups is disclosed in German Utility Model No. G 9,204,667.3 which corresponds to U.S. Pat. No. 5,335,871. Consequently, this publication is incorporated into the disclosure of the present patent application by reference.

One additional method and winding device of this essential type is disclosed in British patent 2,157,273 A. In this case, the reel quality essentially is influenced due to the fact that the component of force that acts against a load roller which, in turn, influences the nip of the drum situated at the higher elevation is continuously reduced as the reel diameter increases, and that said component of force is the only force that determines the web tension of the reel. As the reel diameter increases, the reel axis is displaced from its original position between the two drums into its final position in which the weight of the reel rests vertically on the drum situated at the lower elevation, i.e., the drum axis and the reel axis lie vertically on top of one another.

The invention is based on the objective of reducing the initially mentioned limitations of conventional twin drum reel-ups which are caused by the high nip pressures between the reel and both drums.

The object of the invention in particular pertains to a method by means of which the nip pressure of one of the two drums is reduced to such an extent that the remaining nip pressure just suffices for transferring the torque difference required for generating the desired winding tension onto the reel. This measure results in a winding device which combines one drum of large caliber with one back-up roller of substantially smaller caliber. One additional object of the invention pertains to combining this arrangement with a central drive for the winding shaft which is displaced relative to the drum(s) during the winding process.

One additional object of the invention pertains to a winding device with two drums which makes possible a displacement of the winding shaft along a predetermined line of motion which essentially extends in the vertical direction or is tilted slightly with respect to the vertical line by progressively lowering one drum in dependence on the increasing diameter of the reel. The combination of this arrangement with a central drive for the winding shaft is also particularly preferred in association with the object of the invention. One additional object of the invention is the combination of a twin drum reel-up with an automatic winding tube supply device, in particular for instances in which the winding shaft is provided with an additional drive in the form of a central drive.

One additional object of the invention pertains to a handling device for exchanging the reels in a twin drum reel-up after completing the winding process. This handling device also may be utilized in an advantageous fashion independently of the lowering of one of the drums during the winding process as well as independently of the movement of the winding shaft along a predetermined line of motion.

Details of the solutions according to the invention are disclosed in the following description.

Figure 2:
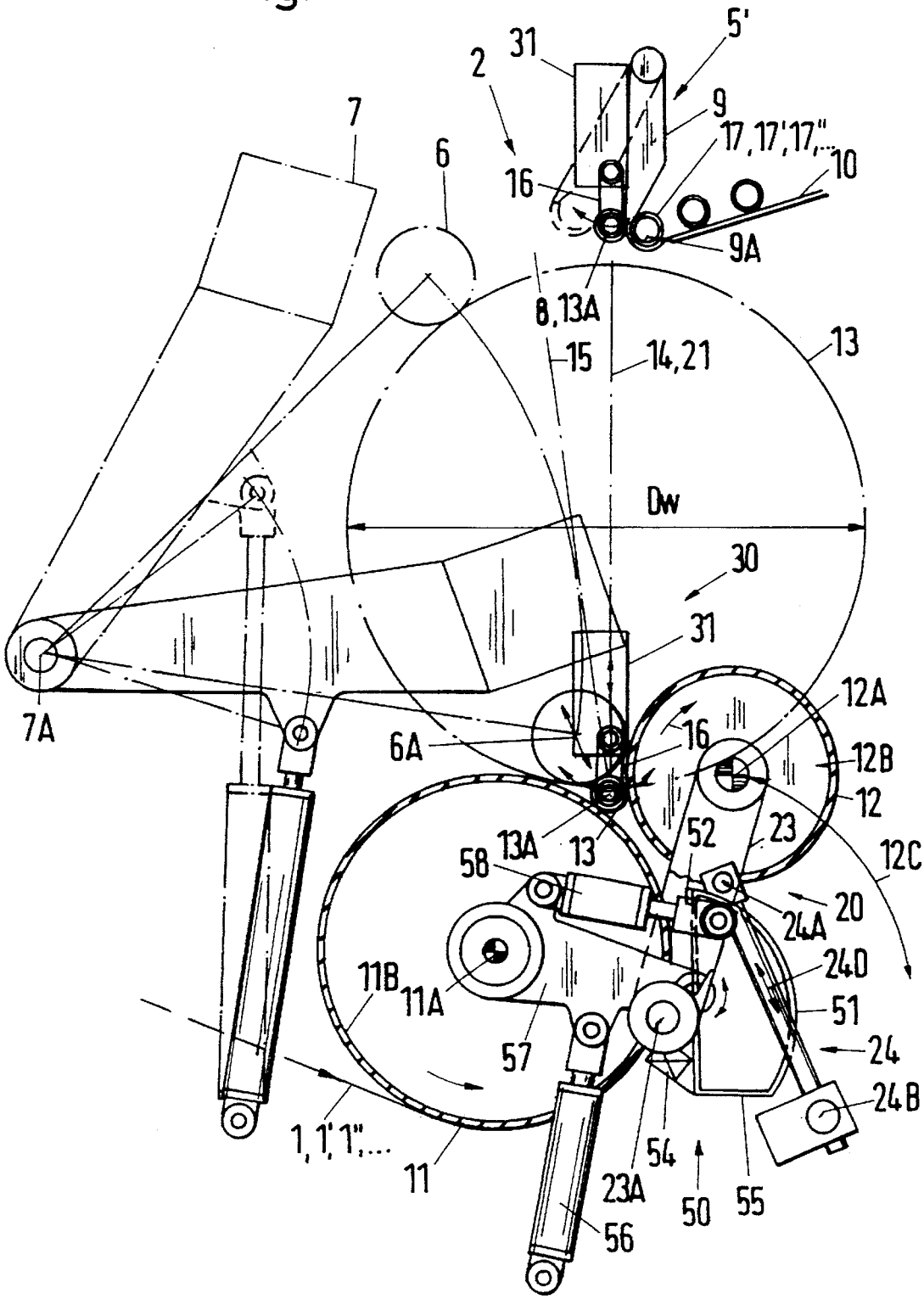
Figure 3:
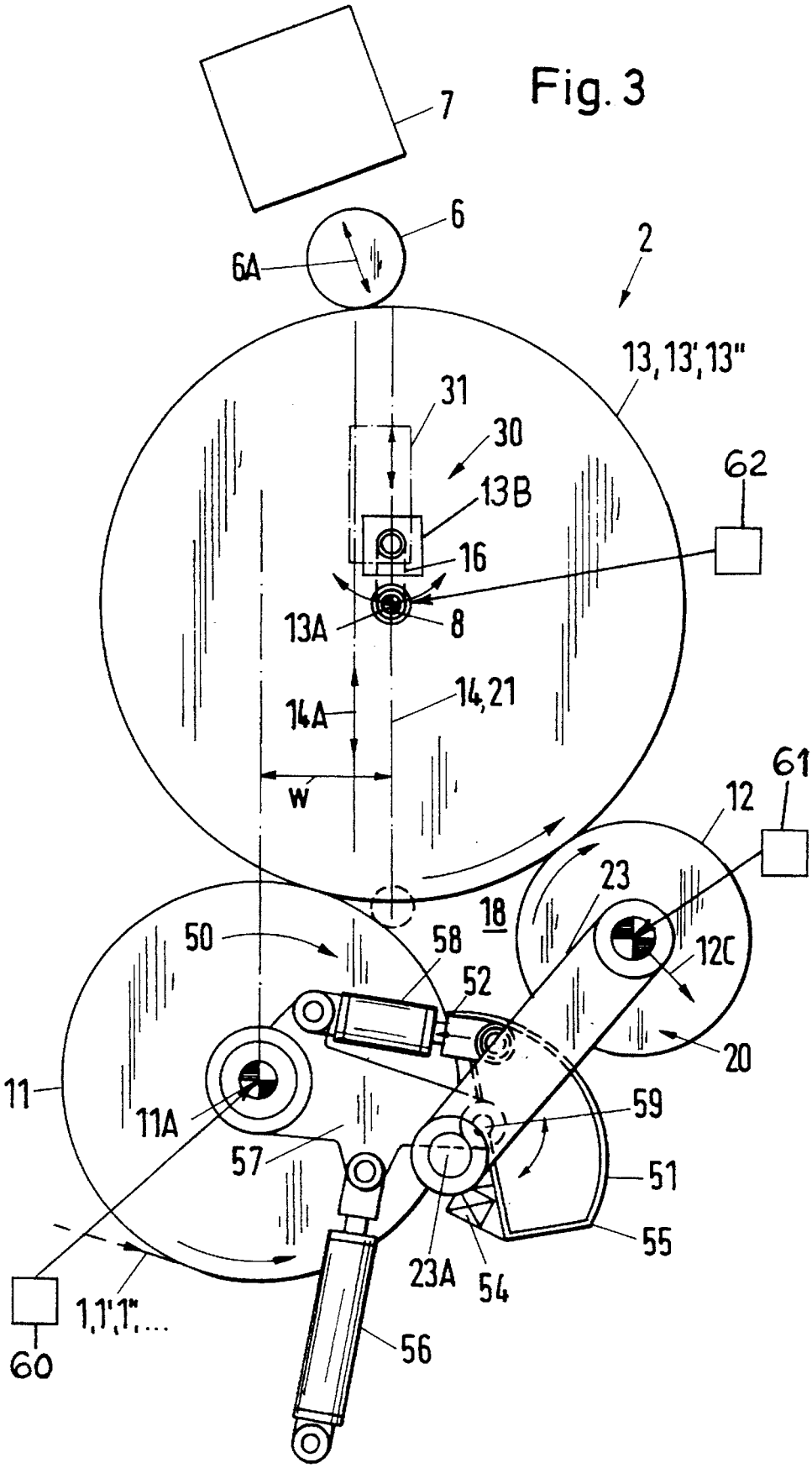
Figure 4:
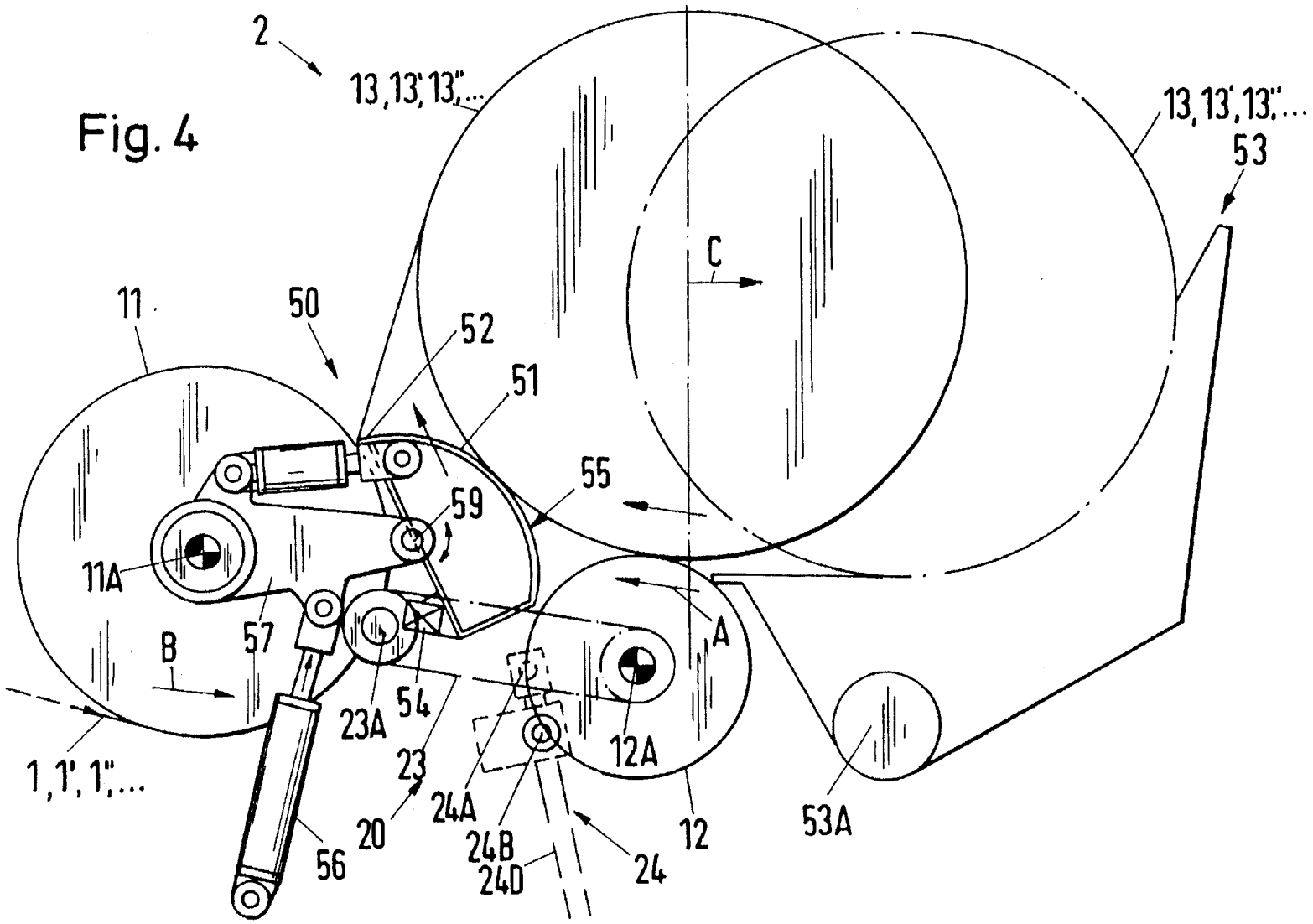
Figure 5:
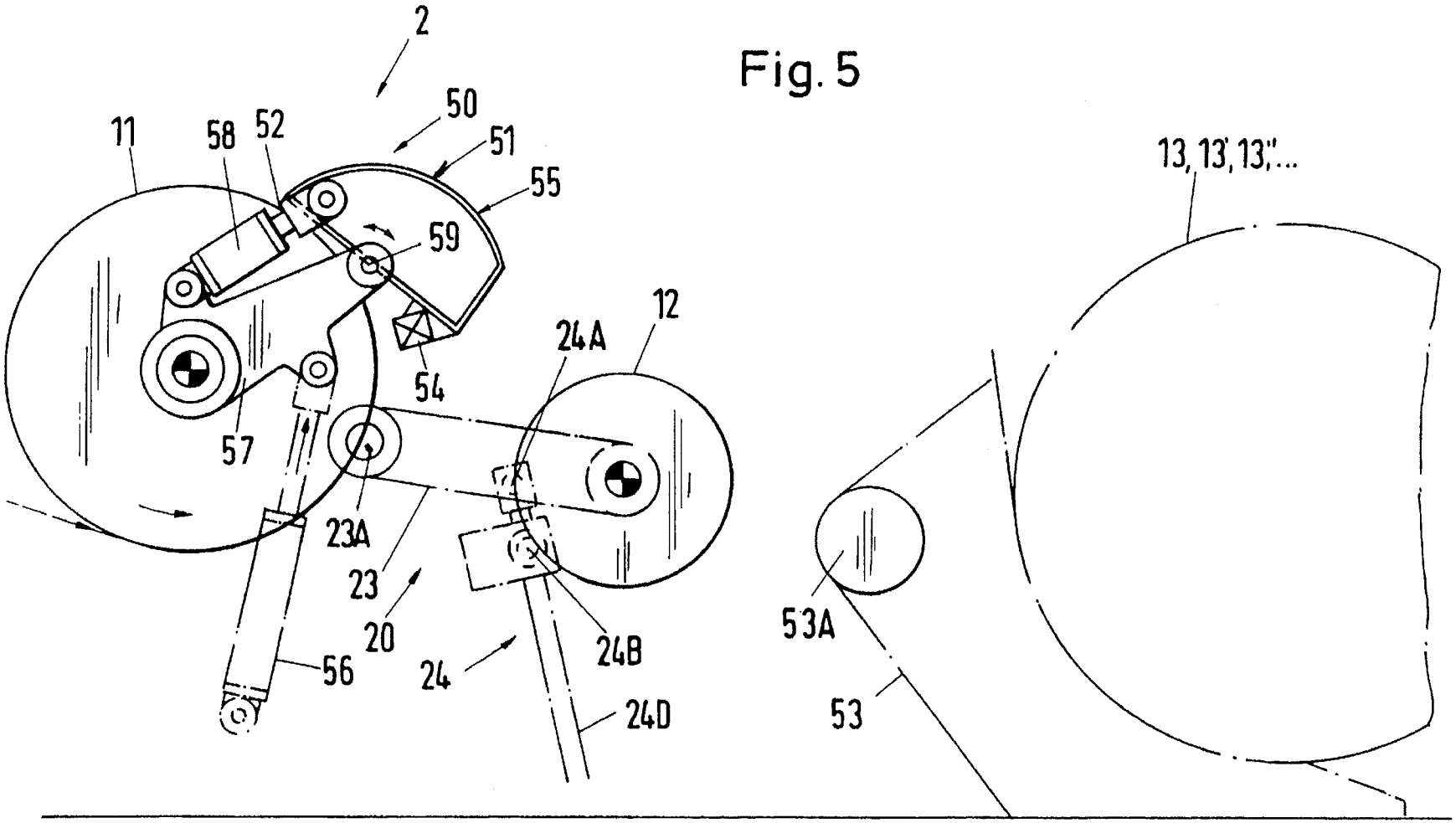

Additional details, characteristics and advantages of the object of the invention are disclosed in the following description of the corresponding figures in which preferred embodiments of the winding device according to the invention are illustrated as examples. The components to be utilized according to the invention are not subject to any particular exceptions with respect to their size, shape, material selection or technical concept, so that the selection criteria known in the respective field of application may be applied in an unrestricted fashion. The figures show:

FIG. 1: a basic representation of a winding device, namely a view of the face side of the drums with a first winding core supply device;

FIG. 2: the core piece of an alternative embodiment of the winding device with a second embodiment of a winding core supply device as well as an alternative embodiment of a load roller and a manipulation device for exchanging the reels after completing the winding process;

FIG. 3: a different alternative of the embodiment according to FIG. 2, whereby the load roller in the embodiment according to FIG. 1 is realized; the operating position corresponds to the completion of the winding process immediately before exchange of the reels;

FIG. 4: the winding device illustrated in FIG. 3 in the position in which the reels are exchanged, and FIG. 5: the winding device illustrated in FIGS. 3 and 4 in the position immediately before the completion of the exchange of the reels.

FIG. 1 shows that the web 1 or the webs 1', 1", . . . which practically extend directly adjacent to one another is/are wound at a winding station 2. The web/webs is/are initially unwound from a supply reel 3 of very large diameter and width. Subsequently, the web 1 is deflected several times and, if necessary, divided longitudinally into parallel partial webs 1', 1", . . . at 4. This entire portion of the installation which is not part of the object of the invention was omitted in the remaining figures so as to provide a better overview.

The winding station 2 comprises reel support drums, or king rolls 11 and 12 which are driven for example by motors 60, 61, respectively, shown schematically means 20 for displacing the shaft 12A of the second king roll 12 as seen from the moving direction of the web axially parallel with respect to the shaft 11A of the first king roll 11 as seen from the moving direction of the web, as well as means 30 which cause a lowering of the shaft 12A of the second king roll 12 in dependence on the increasing diameter $D_w$ of the reel 13; 13', 13", . . . (see FIGS. 2 through 5) to be produced from the web 1 or the webs 1', 1", . . . in such a-way that the shaft 13A of the reel 13 moves along a predetermined vertical line of motion 14 or a line of motion 15 which is only slightly tilted with respect to the vertical plane.

The first and second drums, king rolls 11 and 12, respectively basically have a different diameter, and their shafts 11A and 12A are basically situated at different elevations during the winding process. In the preferred embodiments illustrated in the figures, the first king roll 11 as seen from the moving direction of the web has the larger diameter, and the second king roll 12 has the smaller diameter, whereby the shaft 12A of the second drum is situated at a higher elevation than the shaft 11A of the first drum during the winding process. In addition, at least the king roll 12 of smaller diameter is provided with a relatively pliable mantle 12B in the embodiment shown. Examples of pliable outer coatings for drums are known from the initially mentioned German Utility Model No. 9,204,667.3, as well as the publications cited therein.

In the preferred embodiment shown in the figures, pivoting arms 23 are provided as the means 20 for displacing the shafts. These arms are arranged on both face ends of the king roll 12, i.e., arranged in pairs. On one end of this drum is situated a stationary pivoting axis 23A, while its other end carries the axis of rotation 12A of the king roll 12. The selection of the location at which the pivoting axis 23A of the pivoting arms 23 is attached in relation to the position of the shaft 11A of the king roll 11 as well as their length determine the shape and the position of the line of motion 12C of the shaft 12A of the king roll 12. If the pivoting axis 23A is arranged laterally to the axis 11A of the king roll 11 as it is preferred and illustrated in the figures, i.e., both axes do not coincide, the distance between the axis 11A and 12A is changed during the displacement of the king roll 12. The position of the pivoting axis 23A of the pivoting arms 23 preferably is chosen as shown in the figures, namely such that the lateral distance between the king rolls 11 and 12 becomes larger as the diameter of the reel 13 to be produced increases. The increase in this distance can be seen in particularly clear fashion when comparing the operating positions illustrated in FIGS. 2 and 3. The pivoting movement of the arms 23 is caused by means of a push rod device 24 which is illustrated schematically in FIGS. 1, 2, 4 and 5. During the pivoting process, the push rod bearing 24A moves around the pivoting axis 23A of the pivoting arm 23 along an arc. This movement is indicated by the line 24C. During this pivoting movement, the shaft 24B of the second bearing of the push rod device remains stationary, while the push rod 24D is pushed through the second bearing a certain distance in the direction of the double arrow.

In the embodiment according to FIG. 1, the winding cores 17; 17', 17", . . . are, if used at all, supplied to the pocket (winding bed 18) formed between the king rolls 11 and 12 in conventional fashion over the summit of the king roll 11 by means of a pivoting supply device 5. In FIG. 1, the position in which the winding cores are received is illustrated by broken lines, while the position in which the winding cores are released into the pocket between the two drums is illustrated by continuous lines.

The difference between the elevation of the shafts 11A and 12A of both king rolls 11 and 12, the distance between these two shafts, the line of motion 12C of the shaft 12A of the king roll 12 as well as the displacement of the shaft 12A of the king roll 12 while the diameter of the reel 13 to be produced increases may now be predetermined by means of the preferred winding stations 2 illustrated in the figures in such a way that the main load of the reel 13 is carried by the stationary king roll 11 during the entire winding process, while the king roll 12 always only adjoins the reel 13 with a minimal nip pressure which is necessary for transferring the torque difference required for generating the desired winding tension onto the reel 13. These measures make it possible that reels with a relatively large final diameter and correspondingly heavy weight may be realized with the desired winding tension or change of the winding tension in accordance with the actual diameter of the already produced reel via relatively simple mechanical means and a comparatively small measurement and regulation expenditure.

The means 30 which—as mentioned previously—cause the shafts 13A of the reel 13 to be produced to move along predetermined lines of motion 14, 15 while the shafts 12A of the king roll 12 are lowered may be realized in different ways. In the embodiments shown in the figures, in particular in the preferred embodiments shown in FIGS. 1 through 3, the lines of motion 14 or 15 of the winding shafts 13A extend in a linear fashion. The line of motion 14 extends vertically, while the line of motion 15 shown in the alternative embodiment according to FIGS. 1 and 2 is slightly tilted with respect to the vertical plane. The means 30 illustrated in FIGS. 1 through 3 comprise two guide blocks (guide shoes 31) which are arranged in pairs, whereby said guide blocks may be displaced parallel to the desired line of motion 14 or 15 by means of a pair of guides 21 or 22, and said guide blocks are coupled to the reel 13, preferably the winding shaft 13A, in a suitable fashion.

The coupling between the means 30 and the reel 13 in the preferred embodiment shown in the figures is realized by arranging an articulated element 16 between the guide shoe 31 and the shaft 13A of the reel 13, whereby the articulated element 16 engages directly or indirectly with the winding core 17 of the reel 13 at the side of the winding shaft. This articulated element provides the winding shaft 13A with a certain movability perpendicular to the direction in which the desired line of motion 14 or 15 extends, in particular a slight pendular movement with the component of horizontal motion of the shaft 13A. A deviation of this pendular movement from a desired zero position which corresponds to the nominal position of the winding shaft 13A along the line of motion 14 or 15 may be used by a signal device 13B, as shown schematically in FIG. 3, and which is operatively associated with the articulated element 16, a signal for the displacing element 20 to lower the drum axis 12A additionally or reverse a previous lowering movement that has exceeded the desired distance by the corresponding value. It goes without saying that other position detectors for the winding shaft 13A may be considered, instead of an articulated element 16, e.g., contact rails arranged on both sides of the guides 21 or 22 which release a signal in one or the other direction if the winding shaft 13A begins to deviate from the predetermined line of motion 14 or 15 in one or the other direction.

Measuring devices which are suitable for detecting horizontal or vertical or horizontal and vertical deviations of the shaft 13A of the reel 13 from the predetermined line of motion 14 or 15 and correcting the actual position of the axis 12A of the king roll 12 may be considered as the means 30. Neither the guides 21 and/or 22 nor the guide shoes 31 are absolutely mandatory for this purpose. However, the guides and the guide shoe represent simple and functionally safe mechanical means for realizing the desired line of motion of the winding shaft 13A during the progressing winding process and defining the axial position(s) of the reel(s) 13; 13', 13", . . . .

Due to the fact that the means 30 insure a predetermined progression of the position of the winding shaft 13A during the winding process, a simple and functionally safe realization of an additional rotary drive for the reel to be produced is made possible at its center of rotation which is formed by the winding shaft 13A (center drive). A center drive of this type reduces the torque to be transferred onto the reel 13 by the king rolls 11 and 12. This measure in particular makes possible an improved structure of the reel, i.e., a superior predetermination of the reel density.

In the embodiments shown in FIGS. 1–3, a corresponding center drive motor 62 is fastened to the guide shoe 31, if necessary, on the articulated element 16, whereby the guides 21 or 22 or guides which extend parallel to the aforementioned guides insure a secure guidance of the center drive which engages with at least one side of the winding shaft 13A.

In particular, in instances in which a center drive for the winding shaft 13A is not provided, it may be practical to utilize a well-known load roller 6. In the embodiments illustrated in FIGS. 1 and 3, this load roller is held by a crosspiece 7 and may be moved relative to said crosspiece in the direction of the double arrow 6A so as to be pressed against the already produced reel with an adjustable force, namely in a position that is situated approximately opposite to one of the drums. The arrangement consisting of the crosspiece 7 and the load roller 6 follows the line of motion 14 or 15 of the winding shaft 13A as the diameter of the reel 13 increases. This is indicated by the double arrow 14A and a dot-dash line in FIGS. 1 and 3. FIGS. 1 and 3 also show that the center of the load roller 6 preferably moves at a certain lateral distance from the line of motion 14 of the winding shaft 13A. Guides 21 or 22 or guides which extend parallel to said guides may, if necessary, also be provided for guiding the arrangement consisting of the load roller 6 and the crosspiece 7.

FIG. 2 indicates that the load roller 6 can also be moved by a crosspiece which may be pivoted about a shaft 7A. The line of motion of the load roller 6 has the shape of a segment of a circle.

It should also be emphasized that the dimensional relations of the individual components do not correspond with respect to their scale. The components according to the invention, rather, are illustrated in a partially enlarged representation. This in particular applies to the relation between the winding station 2 and the supply reel 3, the guidance of the web 1 to be rewound as well as the longitudinal divider 4 illustrated in FIG. 1.

FIG. 2 shows an automatically operated supply device 5' for one or more winding cores 17 or 17', 17", . . . that are situated behind one another in the axial direction, whereby said supply device is located on top of the starting position of the reel 13 to be produced which is illustrated in FIG. 2, so that the transfer to a tensioning device 8 is carried out in a position in which the shafts of the winding cores intersect the line of motion 14 of the winding shaft 13A. In FIG. 2, the supply device 5' for supplying the winding cores is positioned in association with the line of motion 14. The tilted line of motion 15 in this figure solely represents an alternative and consequently is not discussed in the following description.

In the preferred embodiment illustrated in FIG. 2, the supply device 5' is provided with at least one pivoting arm 9, on the lower free end of which is situated a holding trough 9A for accommodating the winding cores 17; 17', 17", . . . such that they are secured in their respective position. The winding cores may roll into the holding trough 9A via a slanted surface 10. The pivoting arm 9 may be pivoted from the holding position illustrated by continuous lines in FIG. 2 into the release position for the winding cores in which the winding shafts 13A intersect the line of motion 14. In this position, the tensioning device 8 which is fastened onto the guide shoe 31 (by means of the articulated element 16) takes hold of the ends of the winding cores. In an instance in which several winding cores 17', 17", . . . are situated behind one another, the tensioning device takes hold of a guide rod which penetrates through all winding cores. A subsequent lowering of the winding core into the starting position for the winding process which is illustrated in the bottom portion of FIG. 2 is made possible by continuing the pivoting movement of the pivoting arm 9 beyond the transfer position such that it is released from the winding cores (left position of the pivot arm 9 in FIG. 2). The lowering into the starting position is carried out by subsequently lowering the guide shoe 31.

For reasons of simplicity, the supply device 5' may also be positioned at the winding station in a stationary fashion.

FIG. 2 also comprises a handling device 50 for exchanging the reels 13 after the completion of the winding process. In FIG. 2, this handling device is situated in its rest position. The handling device is described below with the aid of FIGS. 3 to 5.

FIG. 3 shows the situation at the end of a winding process. The finished reel 13 is still situated in the winding position—as is the king roll 12 which is lowered as compared to its starting position (FIGS. 1 and 2) while increasing the distance to the king roll 11 in such a way that the winding shaft 13A of the reel 13 still intersects the predetermined line of motion 14.

The handling device 50 which was illustrated in FIG. 2 is provided for exchanging the reels 13. The handling device is provided with a table-like crosspiece 55 which preferably extends parallel to the shaft 11A of the king roll 11 laterally next to it, i.e., the handling device is arranged in movable fashion in a position which is approximately situated between the drums. A spindle or a piston/cylinder unit 56 in cooperation with the holding arms 57 makes possible a pivoting movement of the crosspiece 55 about the shaft 11A of the king roll 11. In FIG. 3, the holding arms 57 are still situated in the resting position shown in FIG. 2. The crosspiece 55 may be pivoted about a coupling point 59 that is situated at the location at which the holding arms 57 and the crosspiece 55 are connected to one another by means of a second spindle or piston/cylinder unit 58.

Whereas the pivoting movement of the crosspiece 55 illustrated in FIG. 2 around the coupling point 59 is selected such that the crosspiece 55 is not in contact with both king roll 11 and 12, the crosspiece 55 illustrated in FIG. 3 is pivoted against the king roll 11 in such a way that a separating knife 52 provided longitudinally at the crosspiece 55 moves in to cross-cutting engagement to the web 1, 1', 1", wrapped around the king roll 11.

The separating process of the web/webs by means of the separating knife 52 is carried out in association with the ejection of the finished reel 13 from the winding position. This is illustrated in FIG. 4.

FIG. 4 shows that the separating knife 52 of the handling device 52 either is combined with a clamping element or serves as the clamping element which clamps the web 1, 1', 1", . . . that is/are looped around the king roll 11 against the king roll 11 during an exchange of the reels. In order to eject the finished reel 13 from its winding position, the king roll 12 is lowered additionally in the direction of the line of motion 12C (FIG. 3) by means of the displacing elements 20. Thus, the reel 13 remains in contact with both king rolls 11 and 12. The reel 13 or the reels 13', 13", . . . situated one behind the other roll over the outer surface of the king roll 11, while the king roll 12 rotates freely in the direction of the arrow A. In order to remove the reel 13 from the king roll 11, the crosspiece 55 is pivoted through the gap between the king rolls 11 and 12 which now is substantially larger by means of the piston/cylinder unit 56. Thus, the king roll 11 is turned a certain distance in the direction of the arrow B. This is made possible by the clamping element on the separating knife 52 in association with the pivoting movement of the holding arms 57 and the crosspiece 55 around the drum axis 11A. During this pivoting movement, an arc-shaped contact surface 51 initially contacts the periphery of the reel 13 and serves as a rolling surface during the continued pivoting movement of the crosspiece 55. This rolling surface serves for pushing the reel 13 over the top of the king roll 12. A generally known reel lowering table 53 which previously was pivoted into its transfer position illustrated in FIG. 4 about its shaft 53A takes over the reel 13 which rolls over the outer surface of the king roll 12 and subsequently lowers it by carrying out a pivoting movement around its shaft 53A (see FIG. 5).

Due to the fact that the reel 13 is moved away from the king roll 11 by means of the crosspiece 55, the end of the web on the reel 13 places itself around the separating knife 52, whereby said process serves for the continued movement of the reel 13 in the direction of the arrow C so as to separate the web/webs.

Subsequently, the crosspiece 55, if necessary, is pivoted additionally until the end of the web which is clamped on the king roll 11 by means of the crosspiece has reached that particular position on the periphery of the king roll 11 in which the next winding process begins. This position is illustrated in FIG. 5 and, in broken lines, in FIG. 3, whereby said position corresponds to a position which preferably is situated between approximately 1:00 and 2:00 o'clock.

The handling device 50 which serves as a multifunction device is also provided with a glue reservoir 54 which is supplied with glue via lines (not illustrated in the figures) situated at a location in the vicinity of the separating knife 52 or glue nozzles arranged in the vicinity of the clamping elements, so that the end of the web may be connected to the next winding core 17, winding cores 17', 17", . . . at the periphery of the crosspiece 11 and the next winding process may begin; alternatively, stationary or traversing adhesive tape dispensers for fastening the end of the web onto the new winding core may be provided on the handling device 50.

The web(s) 1; 1', 1", . . . are held on the king roll 11 in conventional fashion by means of vacuum until the multifunction device 50 has returned to its rest position, the king roll 12 has reassumed its winding position and a new winding core is situated in the winding bed (FIGS. 1 and 2).

List of reference symbols:

1 Web
1' Web
1" Web
2 Winding station
3 Supply reel
4 Longitudinal divider
5 Supply device
5' Supply device
6 Load roller
6A Double arrow
7 Crosspiece
8 Tensioning device
9 Pivoting arm
9A Holding trough
10 Surface
11 Drum
11A Drum shaft
11B Outer surface of the drum
12 Drum
12A Drum shaft
12B Outer surface of the drum
12C Line of motion of the drum
13 Reel
13' Reel
13" Reel
13A Winding shaft
14 Line of motion
14A Double arrow
15 Line of motion
16 Articulated element
17 Winding core
17' Winding core
17" Winding core
18 Winding bed
20 Displacing element
21 Guidance
22 Guidance
23 Pivoting arm
23A Pivoting arm shaft
24 Push rod device
24A Pivoting shaft
24B Pivoting shaft
24C Line of motion
24D Push rod
30 Moving means
31 Guide shoe
50 Handling device
51 Contact surface
52 Separating knife
53 Reel lowering table
54 Glue reservoir
55 Crosspiece
56 Piston/cylinder unit
57 Holding arms
58 Piston/cylinder unit
59 Coupling point
A Arrow
B Arrow
C Arrow
$D_1$ Drum diameter
$D_2$ Drum diameter
$D_w$ Reel diameter

I claim:

1. A method of winding one or more traveling webs onto a core having a rotational axis, the method utilizing winding apparatus including first and second rotatably driven drums having outer cylindrical surfaces and parallel axes of rotation, with the first drum being fixedly mounted and having a larger diameter than the second drum, the second drum mounted about an axis which is offset from, and is translationally moveable relative to, the axis of the first drum, the method comprising the steps of:

1) receiving the one or more traveling webs onto a lower portion of the outer surface of the first drum;

2) introducing a fresh core into a winding bed formed in a space between the first and second drums to be supported on the cylindrical surfaces thereof and rotated therewith;

3) wrapping the one or more traveling webs onto the core to begin forming a wound web reel thereon;

4) mounting the core on which the reel is being wound in an articulated element slidably secured in the winding apparatus so as to guide the core on which the reel is being wound to travel in a predetermined path substantially vertically or slightly tilted relative to the vertical as the diameter of the reel increases while permitting slight pendular motion of the reel relative to the vertical;

5) providing a signal device operatively associated with the articulated element, the signal device providing a signal indicative of the pendular movement of the reel; moving the second drum supporting the reel as a function of the signal provided by the signal device;

6) selectively moving the second drum downwardly relative to the first drum such that the winding bed is maintained offset from an imaginary vertical plane through the axis of rotation of the first drum as the diameter of the reel increases, whereby the first drum supports a desired greater portion of the wound web reel load along its nip line of contact therewith, and the second drum supports a desired lesser portion of the wound reel load along its nip line of contact therewith, and said lesser portion being just sufficient to permit the transfer of a desired torque differential between said nips of the first and second drums to generate the desired web tension in the reel.

2. A method of winding one or more traveling webs onto a core having a rotational axis, the method utilizing winding apparatus including first and second rotatably driven drums having outer cylindrical surfaces and parallel axes of rotation, with the first drum being fixedly mounted and having a larger diameter than the second drum, the second drum mounted about an axis which is offset from, and is translationally moveable relative to, the axis of the first drum, the method comprising the steps of:

1) receiving the one or more traveling webs onto a lower portion of the outer surface of the first drum;

2) introducing a fresh core into a winding bed formed in a space between the first and second drums to be supported on the cylindrical surfaces thereof and rotated therewith;

3) wrapping the one or more traveling webs onto the core to begin forming a wound web reel thereon;

4) selectively moving the second drum downwardly relative to the first drum such that the winding bed is maintained offset from an imaginary vertical plane through the axis of rotation of the first drum as the diameter of the reel increases, whereby the first drum supports a desired greater portion of the wound web reel load along its nip line of contact therewith, and the second drum supports a desired lesser portion of the wound reel load along its nip line of contact therewith, and said lesser portion being just sufficient to permit the transfer of a desired torque differential between said nips of the first and second drums to generate the desired web tension in the reel;

5) positioning a handling device for selective movement between the first and second drums to engage or disengage the reel;

6) coordinating the movement of the second drum and the handling device such that when the reel has reached a desired diameter, and the second drum has moved outwardly in coordination with the increase in reel diameter, the movement of the handling device is directed upwardly between the first and second drums to come into supporting engagement with the reel;

7) continuing movement of the handling device to remove the reel from support by the first drum such that the reel is completely supported by the handling device and the second drum;

8) coordinating movement of the handling device upwardly and the second drum downwardly to shift the axis of rotation of the reel to the outer side of the axis of rotation of the second drum away from the handling device, whereby the reel is rolled off its support on the second drum for removal from the winding apparatus.

3. Apparatus for winding one or more traveling webs onto a core to form a web reel comprising, in combination:

first and second drums, each drum having an axis of rotation and an outer cylindrical surface for supporting the reel in nipping engagement therewith in a winding bed intermediate the first and second drums and offset laterally from the axis of rotation of the first drum, the drums having parallel axes of rotation, with the first drum having a larger diameter than the second drum;

drive means operatively connected to each of the first and second drums for rotatably driving the drums;

a moveable arm means mounted in the apparatus for rotatably mounting the second drum, and for translationally moving the axis of rotation of the second drum selectively upwardly or downwardly relative to the axis of rotation of the first drum, the arm means being so structured and arranged so as to be capable of selectively lengthening and shortening the lateral distance of the axes of the first and second drums to maintain the winding bed offset from the axis of rotation of the first drum during the winding operation;

the arm means comprise a pair of pivoted arms with one arm located at each side of the apparatus for rotatably supporting the second drum on a corresponding distal end of each said arm, the proximate end of each of said arms being stationarily mounted for pivotal movement parallel to the rotational axis of the first drum;

push rod means operatively connected in the apparatus with the arm means for effecting pivotal movement of the arm means to selectively position the second drum in a desired lateral and angular position relative to the first drum.

4. Apparatus for winding one or more traveling webs onto a core to form a web reel, as set forth in claim 3, further including:

motor means operatively engageable with the core when the core is in position for winding the reel, the motor means for rotatably driving the reel as it is being wound.

5. Apparatus for winding one or more traveling webs onto a core to form a web reel, as set forth in claim 3, further including:

supply device means for holding a supply of fresh cores, the supply device means operatively associated with the guide shoe means and being so constructed and arranged so as to permit the guide shoe means to receive a fresh core in a winding bed formed between the outer cylindrical surfaces of the first and second reel drums, to be supported thereby, and for receiving the traveling web or webs to initiate the winding of a new reel.

6. Apparatus for winding one or more traveling webs onto a core to form a web reel comprising, in combination:

first and second drums, each drum having an axis of rotation and an outer cylindrical surface for supporting the reel in nipping engagement therewith in a winding bed intermediate the first and second drums and offset laterally from the axis of rotation of the first drum, the drums having parallel axes of rotation, with the first drum having a larger diameter than the second drum;

drive means operatively connected to each of the first and second drums for rotatably driving the drums;

a moveable arm means mounted in the apparatus for rotatably mounting the second drum, and for translationally moving the axis of rotation of the second drum selectively upwardly or downwardly relative to the axis of rotation of the first drum, the arm means being so structured and arranged so as to be capable of selectively lengthening and shortening the lateral distance of the axes of the first and second drums to maintain the winding bed offset from the axis of rotation of the first drum during the winding operation:

holding arm means having proximate and distal ends, the proximate ends pivotally mounted in the apparatus for selective rotation of the distal end into a position intermediate the first and second drums;

handling device means mounted on the distal ends of the holding arm means, the handling device means including a contact surface for engaging the reel;

holding arm actuating means linked in the apparatus with the holding arm means for selectively rotating the holding arm means about its pivotal axis;

handling device actuation means operatively linked with the holding arm means and the handling device means for selectively pivoting the handling device means about the distal end of the holding arm means for selectively engaging the reel with the contact surface.

7. Apparatus for winding one or more traveling webs onto a core to form a web reel comprising in combination:

first and second drums, each drum having an axis of rotation and an outer cylindrical surface for supporting the reel in nipping engagement therewith in a winding bed intermediate the first and second drums and offset laterally from the axis of rotation of the first drum, the drums having parallel axes of rotation, with the first drum having a larger diameter than the second drum;

drive means operatively connected to each of the first and second drums for rotatably driving the drums;

a moveable arm means mounted in the apparatus for rotatably mounting the second drum, and for translationally moving the axis of rotation of the second drum selectively upwardly or downwardly relative to the axis of rotation of the first drum, the arm means being so structured and arranged so as to be capable of selectively lengthening and shortening the lateral distance of the axes of the first and second drums to maintain the winding bed offset from the axis of rotation of the first drum during the winding operation;

guide means operative disposed on either sided of the reel and extending either substantially vertically or at a small angle to the vertical:

guide shoe means mounted in the guide means and so constructed and arranged as to be capable of translational movement in the guide means;

articulated element means pivotally mounted in the guide shoe means, the articulated means being so constructed and arranged so as to be operatively engageable with the core to rotatably support the core, the articulated element means being so constructed and arranged as to permit pendular movement of the core and reel while the guide shoe means is moved translationally in the guide means as the diameter of the reel grows as it is wound;

signal device means operatively associated with the articulated element means for providing a signal corresponding to the position, including the pendular position, of the articulated element means and the reel;

control means operatively associated with the arm means for receiving the signal from the signal device means, and for lowering the second drum as a function of the position of the reel.

8. Apparatus for winding one or more traveling webs onto a core to form a web reel comprising, in combination:

first and second drums, each drum having an axis of rotation and an outer cylindrical surface for supporting the reel in nipping engagement therewith in a winding bed intermediate the first and second drums and offset laterally from the axis of rotation of the first drum, the drums having parallel axes of rotation, with the first drum having a larger diameter than the second drum;

drive means operatively connected to each of the first and second drums for rotatably driving the drums;

a moveable arm means mounted in the apparatus for rotatably mounting the second drum, and for translationally moving the axis of rotation of the second drum selectively upwardly or downwardly relative to the axis of rotation of the first drum, the arm means being so structured and arranged so as to be capable of selectively lengthening and shortening the lateral distance of the axes of the first and second drums to maintain the winding bed offset from the axis of rotation of the first drum during the winding operation;

holding arm means having proximate and distal ends, the proximate ends pivotally mounted in the apparatus for selective rotation of the distal end into a position intermediate the first and second drums;

handling device means mounted on the distal ends of the holding arm means, the handling device means including a contact surface for engaging the reel;

holding arm actuating means linked in the apparatus with the holding arm means for selectively rotating the holding arm means about its pivotal axis;

handling device actuation means operatively linked with the holding arm means and the handling device means for selectively pivoting the handling device means about the distal end of the holding arm means for selectively engaging the reel with the contact surface;

knife means mounted to the handling device for engaging the web against the first drum for severing the web when the handling device actuating means has moved the handling device means to a position intermediate the first and second drums with the contact surface engaging the reel and supporting the reel with the second drum.

9. Apparatus for winding one or more traveling webs onto a core to form a web reel comprising, in combination:

first and second drums, each drum having an outer cylindrical surface for supporting the reel in nipping engagement therewith, the drums having parallel axes of rotation, with the first drum having a larger diameter than the second drum;

drive means operatively connected to each of the first and second drums for rotatably driving the drums;

a movable arm means, pivotally mounted at a proximate end thereof in the apparatus, for rotatably mounting the second drum near a distal end of the moveable arm means, and for translationally moving the axis of rotation of the second drum selectively upwardly or downwardly relative to the rotational axis of the first drum, the moveable arm means being so structured and arranged so as to be capable of selectively lengthening and shortening the lateral distance of the axes of the first and second drums;

holding arm means having proximate and distal ends, the proximate ends privotally mounted in the apparatus coaxially with the axis of rotation of the first drum for selective rotation of the distal ends into a position intermediate the first and second drums;

holding arm actuating means linked in the apparatus with the holding arm means for selectively rotating the holding arm means about its pivotal axis;

handling device means mounted near the distal ends of the holding arm means, the handling device means including a contact surface for engaging the reel;

handling device actuation means operatively linked with the holding arm means and the handling device means for selectively pivoting the handling device means about the distal end of the holding arm means for selectively positioning the contact surface relative to the first drum for engaging and supporting the reel;

knife means mounted to the handling device means for engaging the web against the first drum for severing the web when the handling device actuating means has moved the handling device means to an extended position intermediate to first and second drums where the contact surface is raised to an upper position for engaging the reel and supporting the reel with the second drum;

signal device means operatively associated with the reel for providing a signal corresponding to the size or position of the reel;

control means, including push rod means, operatively associated with the moveable arm means for receiving the signal from the signal device means, whereby the moveable arm means controllably positions the second drum at a lower position as a function of the reel diameter, and the axis of the second drum is moved correspondingly translationally to lengthen the lateral distance between the axes of the first and second drums such that, when the reel reaches a predetermined desired diameter, the handling device means can be moved upwardly between the first and second drums to move its contact surface into supporting engagement with the reel for supporting the reel together with the surface of the second drum and for urging the wound reel over the surface of the second drum for removal of the reel from the winding apparatus.

10. Apparatus for winding one or more traveling webs onto a core to form a web reel, as set forth in claim 9, further including:

guide means disposed on either side of the apparatus and extending substantially vertically for guiding the core on which the reel is being wound in a predetermined path of travel substantially vertically or slightly tilted relative to the vertical as the diameter of the reel increases;

articulated element means pivotally mounted in the guide means and being so constructed and arranged so as to be operatively engageable with the core for rotatably supporting the core, the articulated element means being so constructed and arranged as to permit pendular movement of the core and reel while the reel is moved translationally as the diameter of the reel grows as it is wound.

* * * * *